United States Patent [19]

Olsson et al.

[11] Patent Number: 4,635,571

[45] Date of Patent: Jan. 13, 1987

[54] APPARATUS FOR INFRASONICALLY INTENSIFYING A GLOW BED

[75] Inventors: Mats A. Olsson, Bromma; Roland Sandström, Skellefteå, both of Sweden

[73] Assignee: Insako, Kb, Soedre Brobaenken, Sweden

[21] Appl. No.: 758,555

[22] PCT Filed: Nov. 30, 1984

[86] PCT No.: PCT/SE84/00408

§ 371 Date: Jul. 16, 1985

§ 102(e) Date: Jul. 16, 1985

[87] PCT Pub. No.: WO85/02452

PCT Pub. Date: Jun. 6, 1985

[30] Foreign Application Priority Data

Dec. 2, 1983 [SE] Sweden ..... 8306652

[51] Int. Cl.[4] ..... F23L 13/00

[52] U.S. Cl. ..... 110/297; 110/309; 110/347; 431/1

[58] Field of Search ..... 110/347, 297, 309; 431/1; 111/137 R

[56] References Cited

U.S. PATENT DOCUMENTS

| | | | |
|---|---|---|---|
| 2,945,459 | 7/1960 | Junkermann . | |
| 4,359,962 | 11/1982 | Olsson et al. | 116/137 R |
| 4,592,292 | 6/1986 | Olsson et al. | 110/347 |

FOREIGN PATENT DOCUMENTS

| | | |
|---|---|---|
| 472812 | 2/1929 | Fed. Rep. of Germany . |
| WO82/03803 | 11/1982 | PCT Int'l Appl. . |
| 7701764 | 8/1978 | Sweden . |
| 281373 | 6/1952 | Switzerland . |

*Primary Examiner*—Edward G. Favors

*Attorney, Agent, or Firm*—Merchant, Gould, Smith, Edell, Welter & Schmidt

[57] ABSTRACT

Method and apparatus for infrasonically intensifying a glow bed (13), supported by a grate (12). In order to improve the beneficial effect of sound on combustion the bed of fuel, located on the grate, is exposed to a high particle velocity of a sound positively produced by an external low frequency sound generator (11) the frequency of which is determined by the sound generator, to provide a reciprocating movement of combustion air and combustion gas through the glow bed. The dimensions of the grate in a plane transverse to the reciprocating movement of combustion air and combustion gas are less than a quarter of the wave-length of the sound generated by the sound generator.

2 Claims, 5 Drawing Figures

APPARATUS FOR INFRASONICALLY INTENSIFYING A GLOW BED

Figure 1:
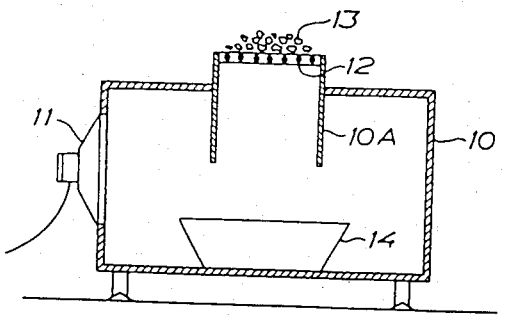

The present invention relates to method and apparatus for infrasonically intensifying a glow bed, supported by a grate.

Already in 1961, F. H. Reynst mentioned that it had at that time been recognized recently that acoustic vibrations have a beneficial effect on combustion. In this connection reference ts made to Pulsating Combustion, pp. 13–15, The Collected Works of F. H. Reynst, Pergamon Press, New York 1961. Although the vibrations may be only very weak, the relative motion of the gas with respect to the fuel particle which results, is sufficient to remove the envelope of combustion products around this particle, resulting in an increase of the combustion rate. Reynst describes the application of this principle to a pulverized coal burner. A mixture of fuel and air is delivered by a fan to a precombustion chamber located between two conical passages flaring in the direction of flow. Volatile components of the fuel are combusted in the precombustion chamber, and the flame is directed into a flame tube. The pulsations of tne flame in the precombustion chamber are propagated into the flame tube wherein the column of gas is set in resonance so as to move relatively with respect to the fuel particles, which speeds up the combustion as mentioned above.

Swedish patent specification No. 7701764-8 (publication No. 412,635) describes a method of combusting atomized solid, liquid or gaseous fuels, which is based on the principle mentioned by Reynst. However, according to this patent specification, the vibrations are not generated by the burner flame. Sound energy is supplied to the combustion flame by external means such as a sound emitter, the frequency of the sound ranging from infrasound frequencies to ultrasound frequencies. However, the method of the Swedish patent specification No. 7701764-8 apparently has not yet been utilized practically to any significant extent, which may indicate that it has not been possible so far to develop the method for industrial application.

Similar methods are described in Swiss patent specification No. 281,373 and German patent specification 472,812. According to the Swiss patent specification, vibration is imparted to at least part of the combustion chamber and the flue gases, and according to the German patent specification, a dispersion of particulate fuel and combustion air as well as secondary combustion air is brought to oscillate.

The USSR Author's Certificate 228,216 (V. S. Severyanin) describes a pulsating combustion in a bed whereby the hot grid of the Rijke tube is replaced by a layer of solid fuel in which free oscillation will develop. The effect obtained is, however, relatively low, because only self-generated oscillation is utilized.

U.S. patent specification No. 1,173,708 describes a method for burning fuel wherein the particles of a fuel bed laying on a grate are agitated by pu1sating combustion air supplied from below through the grate. The particles of fuel are suspended and floated by the air and are permitted to settle in the time intervals between the pulsations.

The primary object of the invention is to provide a combustion method which further improves the beneficial effect of sound on combustion.

In accordance with the object of the invention this provides a metnod of the kind referred to above which has obtained the characteristics of claim 1.

The invention also provides an apparatus for working the method as defined in claim 1.

Figure 4:
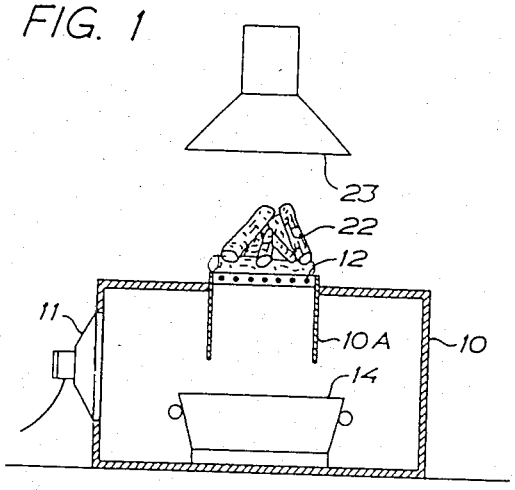
Figure 5:
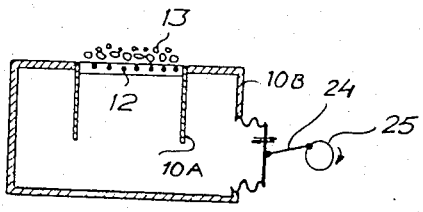
Figure 3:
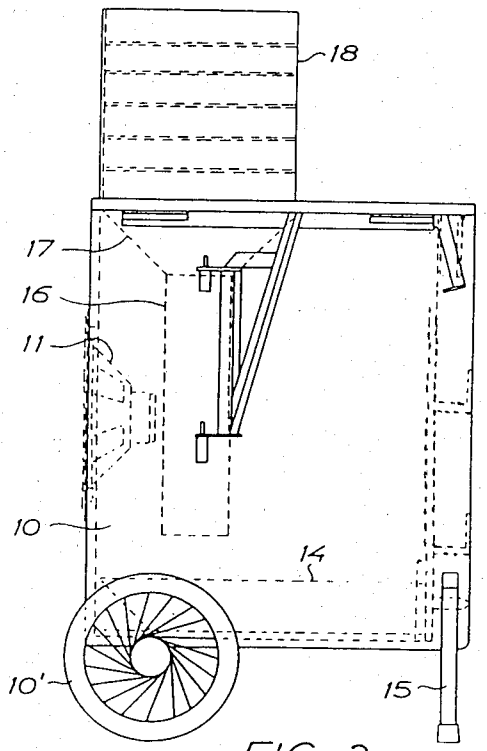
Figure 2:
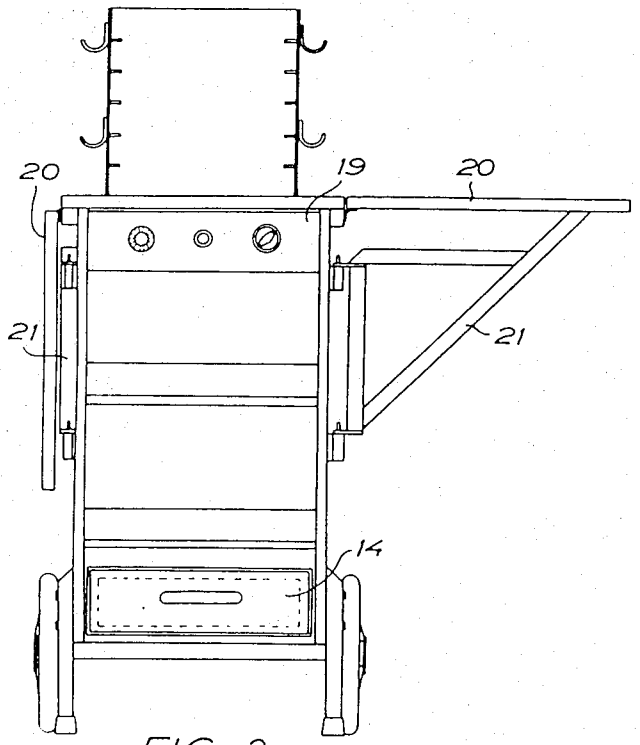

For the explanation of the invention in more detail reference is made to the accompanying drawings which disclose several embodiments of the invention and wherein FIG. 1 shows a diagrammatic vertical cross-sectional view of a barbecue grill according to the invention, with a Helmnoltz resonator, FIG. 2 is an end view of a constructive embodiment of the grill of FIG. 1, FIG. 3 is a side view of the grill shown in FIG. 2, FIG. 4 shows a diagrammatic vertical cross-sectional view of an open fire stove according to the invention, with a Helmholtz resonator, and FIG. 5 shows a diagrammatic vertical cross-sectional view of a barbecue grill according to the invention wherein the sound is generated by a bellows type sound generator.

Referring to FIG. 1, the barbecue grill shown therein comprises a Helmholtz resonator 10 of a construction known per se, having a low natural frequency and provided with a drive unit consisting of an electrical loudspeaker element 11. Resonator 10 and element 11 form together a low frequency sound generator. The maximum frequency of the sound should be 30 Hz. Preferably, the frequency is about 20 Hz or lower. A grate 12 supporting the fuel bed 13 is mounted in the opening of the neck 10A. or closely above. When the generator is operating a high velocity of reciprocating air, termed particle velocity, is obtained at the opening of the neck 10A where the grate is located. The dimensions of the area of the grate in a plane transverse to the axis of the neck should be less tnan a quarter of the wave length of the sound generated by the sound generator. Then, there is obtained a high velocity reciprocating movement of combustion air and combustion gas tnrough the fuel bed and the grate under the influence of the low frequency sound.

Inside the resonator 10 and below the neck 10A a container 14 is located to receive ash particles falling down from the grate 12.

When grilling food it is desired to obtain in a short time a glow bed, e.g of grill charcoal or coal. Normally, in grills of conventional design, the period extending from ignition of tne fuel up to the time when the glow bed is established, is 30 minutes or more. When the bed 13 after ignition is subjected to a high particle velocity caused by a low frequency sound excited by means of the loudspeaker element 11, said period can be reduced to about 5 minutes. When a suitable glow bed has been obtained, grilling of the food is performed in the usual manner but it is possible if desired to increase the temperature of the glow bed during grilling by simply operating the loudspeaker, thus simple means for controlling the temperature is provided.

In the practical constructive embodiment of the barbecue grill of FIG. 1 as shown in FIGS. 2 and 3 to which reference now is made, the Helmholtz resonator IO forms a chassis provided with wheels 10' and support legs 15. The electrical loudspeaker element 11 is mounted inside the resonator 10, the opening of which is formed by a neck 16 mounted inside the resonator and having a flared upper end portion 17. Over the flared opening in which tne grate is arranged, although it is not shown in FIGS. 2 and 3, there is provided a rack 18 for supporting a grid for the food to be grilled, at a desired level above the grate. The ash container 14 is arranged as a drawer which can be witndrawn from the resonator 10 so as to be emptied. On the resonator, a control panel 19 is arranged for controlling tne intensity of the sound emitted by the electrical loudspeaker element 11. To the resonator, two table tops 20 are hinged and can be held in the operative position by means of struts 21 pivoted to the resonator.

An open fire stove can be arranged in an analogous manner as the barbecue grill of FIG. 1 and this is disclosed in FIG. 4 wherein details corresponding to those in FIG. 1 are provided with the same references. Fire logs 22 are placed on the grate 12 below a stationarily mounted smoke hood 23 connected to a chimney. Under the influence of the high particle velocity, combustion will be more intense such that the content of unburnt gases and solid particles in the smoke will be reduced and the combustion rate increased.

Referring to the modified embodiment shown in FIG. 5, the loudspeaker element is replaced by a bellows type sound generator comprising a bellows of a flexible material and allowing a large stroke as compared with conventional loudspeaker elements. The bellows is connected at an open end thereof to a volume defined by a box 10B at an opening in a side wall of the box below the grate 12 mounted at the opening of the neck 10A. The volume defined by the box has no other communication with the surroundings than that defined by the neck 10A. The other, closed end of the bellows is connected by a crank rod 24 to a crank mechanism 25 for imparting to the bellows a reciprocating movement.

The advantage of this embodiment is that a high particle velocity can be achieved in the opening of the neck 10A without having resonance between the air column in the neck 10A and the air volume in the box. Thus, the volume in the box can be allowed to be much less than in the embodiments previously described.

The bellow can be replaced by a diaphragm allowing a large stroke of the same order as can be obtained by means of the bellows.

Another advantage achieved by the embodiment of FIG. 5 is that the operating frequency can be chosen without being tuned to a definite resonance frequency defined by a resonator considering the fact that such resonance frequency may change during operation of the grill due to temperature variations of the air volume in the resonator.

We claim:

1. Apparatus for burning solid fuel as an infrasonically intensified glow bed, comprising a grate for supporting the glow bed, means forming a cavity, and a low frequency sound generator including a reciprocating member, said grate and said reciprocating member forming parts of the walls of said cavity for exposing the glow bed to pulsating combustion air, wherein the dimensions of the cavity are substantially smaller than the wave-length of the low frequency sound generated and that the grate forms the only communication between the cavity and the surrounding air to provide a high and uniform reciprocating flow of combustion air and combustion gas through the glow bed.

2. Apparatus as claimed in claim 1, wherein a Helmholtz resonator forms said cavity.

* * * * *